US010077097B1

(12) United States Patent
Cheung

(10) Patent No.: US 10,077,097 B1
(45) Date of Patent: Sep. 18, 2018

(54) SURFBOARD HAVING A FIN

(71) Applicant: Loi Hui Cheung, New Territories (HK)

(72) Inventor: Loi Hui Cheung, New Territories (HK)

( * ) Notice: Subject to any disclaimer, the term of this patent is extended or adjusted under 35 U.S.C. 154(b) by 0 days.

(21) Appl. No.: 15/612,959

(22) Filed: Jun. 2, 2017

(51) Int. Cl.
*B63B 35/79* (2006.01)

(52) U.S. Cl.
CPC ..... *B63B 35/793* (2013.01); *B63B 35/7926* (2013.01)

(58) Field of Classification Search
CPC .... B63B 35/793; B63B 35/7926; B63B 35/79
USPC ..... 441/74
See application file for complete search history.

(56) References Cited

U.S. PATENT DOCUMENTS 4,848,971 A * 7/1989 Price, Jr. ..... E21D 20/025 405/259.3
5,176,553 A * 1/1993 Tuttle ..... B63B 35/793 441/74
6,896,570 B1 * 5/2005 O'Keefe ..... B63B 35/793 441/79
9,090,318 B2 * 7/2015 Koelling ..... A43C 15/161
9,809,285 B1 * 11/2017 Yeh ..... B63B 35/7926

* cited by examiner

*Primary Examiner* — Anthony D Wiest
(74) *Attorney, Agent, or Firm* — Cheng-Ju Chiang

(57) ABSTRACT

It includes a surfboard body, a fin box, a fin seat, and multiple screw members. The fin box is embedded with the surfboard body and has a box recess and box holes. Each box hole has several circular slots. The fin seat has a fin and securing portions. Each securing portion has several curved plates for enclosing a receiving space. Each screw member has a tapered portion with an outer threaded portion. When the screw member is rotated in, these curved plates will gradually expand outwards and force the outward protruded portions engaging into the corresponding circular slots. So, the fin seat and the fin box are engaged together. When the screw member is rotated out, the fin seat and the fin box can be separated. About this invention, the fin seat and the fin box can be firmly secured together. Plus, its fin seat can be replaced easily.

2 Claims, 7 Drawing Sheets

SURFBOARD HAVING A FIN

BACKGROUND OF THE INVENTION

1. Field of Invention

This invention relates to a surfboard having a fin. Particularly, it relates to a surfboard having a fin, in which its fin seat is easy to replace. The fin seat and the fin box can be firmly secured as one integral structure. In addition, its fin seat can be replaced easily.

2. Description of the Prior Art

A traditional surfboard (not shown) is disposed with a fin. This fin can be inserted into a socket which is assembled with or formed on the surfboard.

When someone is surfing, this surfboard may be subject to great impact caused by the waves. The fin or the socket might be broken. Hence, it needs to be fixed or replaced by a new one. However, such maintenance work is quite time consuming or inconvenient.

Of course, some surfboard manufacturers tried to modify the fin or socket structure. Nevertheless, it still has the problems like easy to loose, hard to replace, etc.

SUMMARY OF THE INVENTION

The object of this invention is to provide a surfboard having a fin. In which, the fin seat and the fin box can be firmly secured as one integral structure. In addition, its fin seat can be replaced easily. Therefore, this invention can solve the traditional problems as follows. The traditional maintenance work for fin or fin socket is quite time consuming or inconvenient. The traditional one is easy to loose or hard to replace.

In order to solve the above-mentioned traditional problems, this invention is provided as a technical solution.

A surfboard having a fin comprising:

a surfboard body having a first surface, a second surface, a main recess, and a plurality of body holes; the main recess being recessed and formed on the first surface, the body holes being connected between the second surface and the main recess;

a fin box being disposed in the main recess, the fix box including an outer surface, an inner surface, a side surface, a box recess, several box holes; the box recess being recessed and formed on the outer surface, the box holes being connected with the box recess and the inner surface and corresponding to the body holes; each box hole having several circular slots;

a fin seat including a fin engaging socket and several securing portions; the fin engaging socket being able to secure a fin; each securing portion having several curved plates and several elongate gaps; each curved plate including an inner threaded portion and a plurality of outward protruded portions; a receiving space being formed and enclosed by the several curved plates;

a plurality of screw members, each screw member having a tapered portion and an end portion; the tapered portion being formed with an outer threaded portion which is corresponding to the inner threaded portions of the curved plates; the end portion having a connecting portion for allowing the screw member to be rotated;

wherein when the screw member being rotated and inserted into the receiving space, the outer threaded portion being threaded with the inner threaded portion so as to force the curved plates expanding outwards and forcing the outward protruded portions engaging into the corresponding circular slots, so that the fin seat and the fin box being engaged together as an integral structure;

when the screw member being rotated and moving out from the receiving space, the outer threaded portion being threaded with the inner threaded portion so as to allow the curved plates retracting inwards and causing the outward protruded portions separating from the corresponding circular slots, so that the fin seat and the fin box being separated.

BRIEF DESCRIPTION OF THE DRAWINGS

FIG. 5 is a cross-sectional view showing that the screw member is not yet rotated in.

FIG. 6 is a cross-sectional view showing that the screw member is rotated in.

DESCRIPTION OD THE PREFERRED EMBODIMENT

Figure 1:
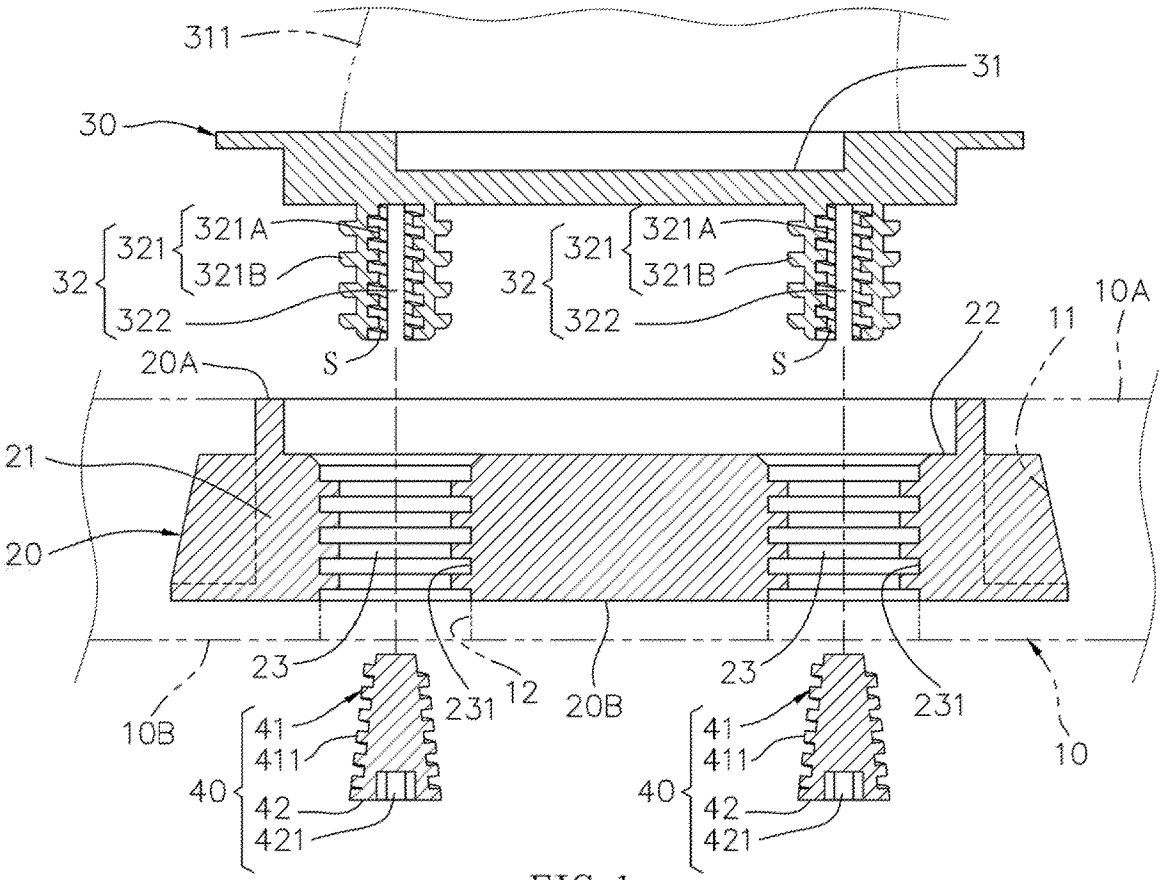
FIG. 1 is a cross-sectional view of this invention in a disassembled condition.
Figure 2:
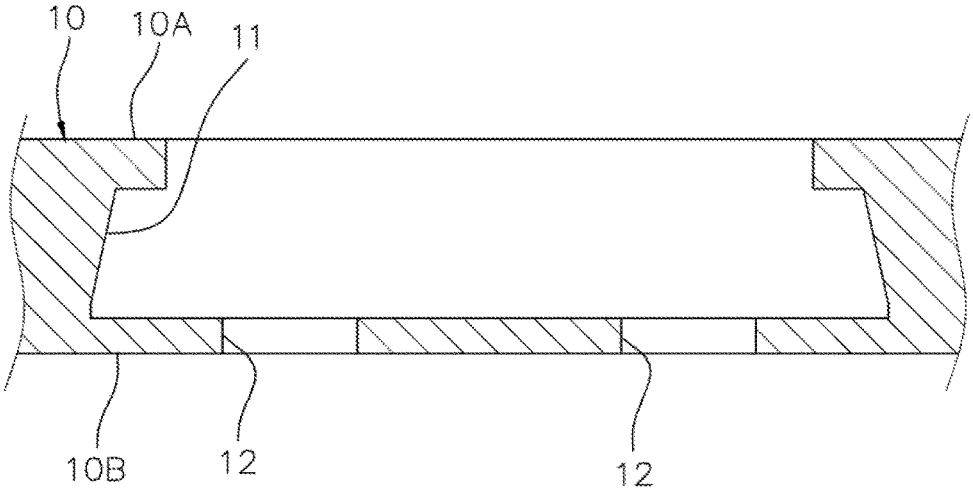
FIG. 2 is a cross-sectional view of surfboard body of this invention.
Figure 3:
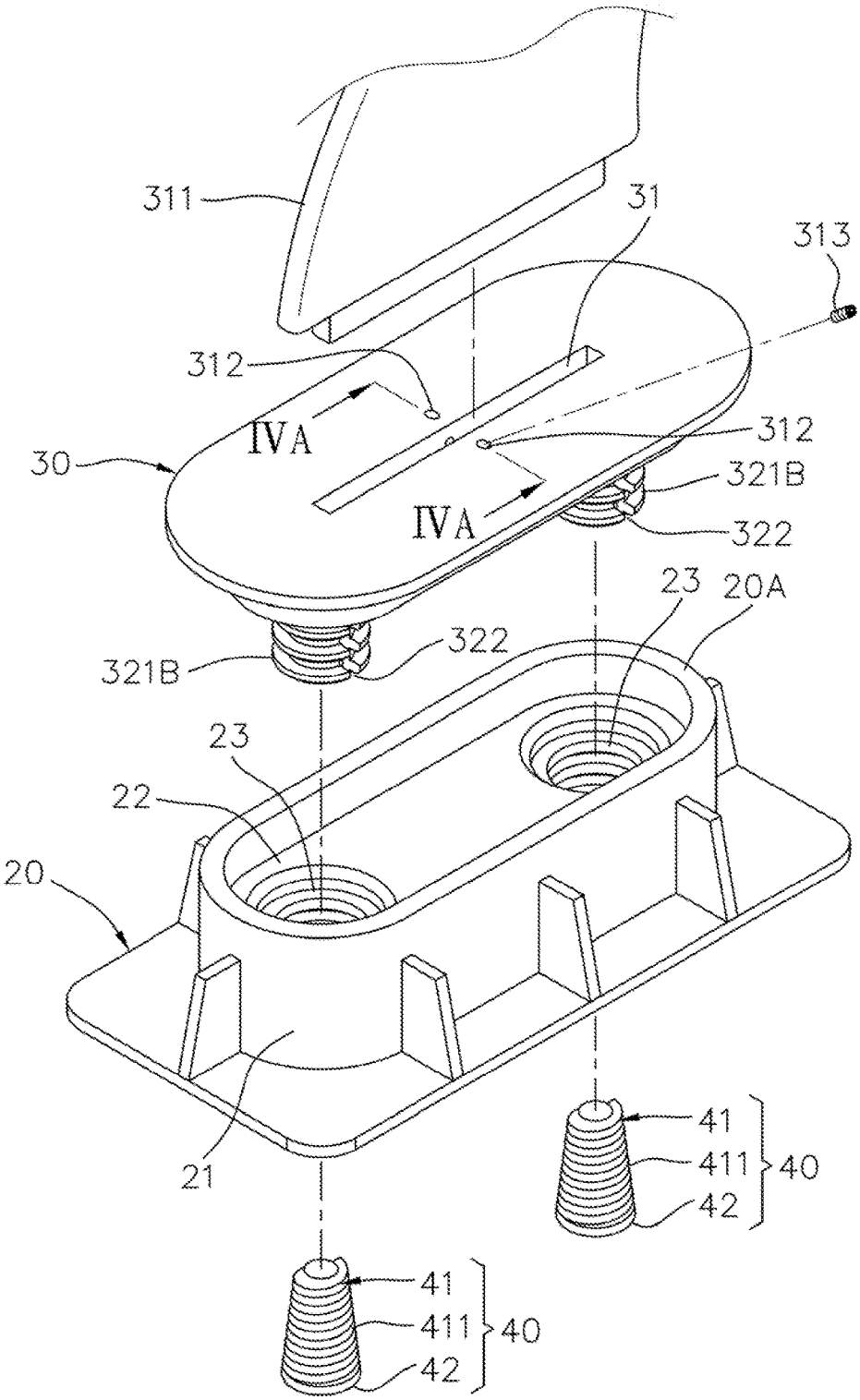
FIG. 3 is a perspective view of this invention in a disassembled condition.

Referring to FIGS. 1, 2, and 3, this invention relates to a surfboard having a fin. It mainly comprises a surfboard body 10, a fin box 20, a fin seat 30, and multiple screw members 40.

With regard to this surfboard body 10, it has a first surface 10A, a second surface 10B, a main recess 11, and a plurality of body holes 12. The main recess 11 is recessed and formed on the first surface 10A. These body holes 12 are connected between the second surface 10B and the main recess 11.

The fin box 20 is disposed in the main recess 11. This fix box 20 includes an outer surface 20A, an inner surface 20B, a side surface 21, a box recess 22, and several box holes 23. The box recess 22 is recessed and formed on the outer surface 20A. The box holes 23 are connected with the box recess 22 and the inner surface 20B and corresponding to the body holes 12. Each box hole 23 has several circular slots 231.

Concerning this fin seat 30, it includes a fin engaging socket 31 and several securing portions 32. The fin engaging socket 31 is able to secure a fin 311. Each securing portion 32 has several curved plates 321 and several elongate gaps 322. Each curved plate 321 includes an inner threaded portion 321A and a plurality of outward protruded portions 321B. A receiving space S is formed and enclosed by these several curved plates 321A.

About these screw members 40, each screw member 40 has a tapered portion 41 and an end portion 42. The tapered portion 41 is formed with an outer threaded portion 411 which is corresponding to the inner threaded portions 321A of the curved plates 321. The end portion 42 has a connecting portion 421 for allowing the screw member 40 to be rotated.

When the screw member 40 is rotated in one direction (ex. clockwise) and gradually inserted into the receiving space S, the outer threaded portion 411 is threaded with the inner threaded portion 321A so as to force the curved plates 321 gradually expanding outwards and forcing the outward protruded portions 321B gradually engaging into the corresponding circular slots 231 of the box hole 23. Thus, the fin seat 30 and the fin box 20 are engaged together as an integral structure.

When the screw member 40 is rotated in an opposite direction (ex. counterclockwise) and gradually moving out from the receiving space S. The outer threaded portion 411 is threaded with the inner threaded portion 321A so as to allow the curved plates 321 gradually retracting inwards (by the resilient force itself) and causing the outward protruded portions 321B gradually separating from the corresponding circular slots 231 of the box hole 23. Thus, the fin seat 30 and the fin box 20 are separated.

Figure 4A:
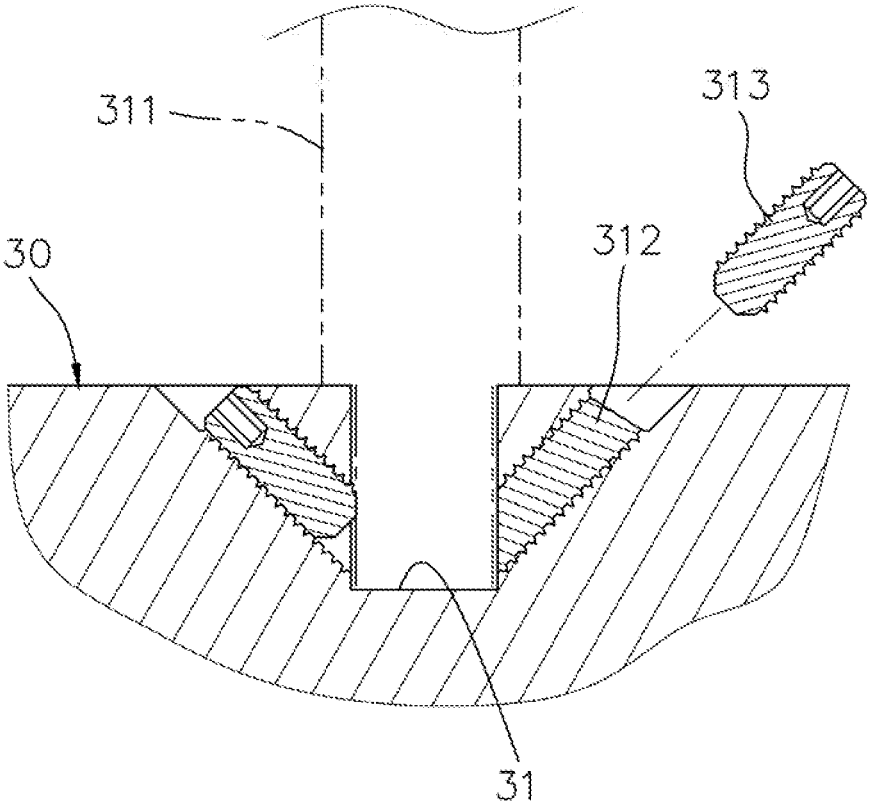
FIG. 4A is a view taken along line WA-WA indicated in FIG. 3.
Figure 4B:
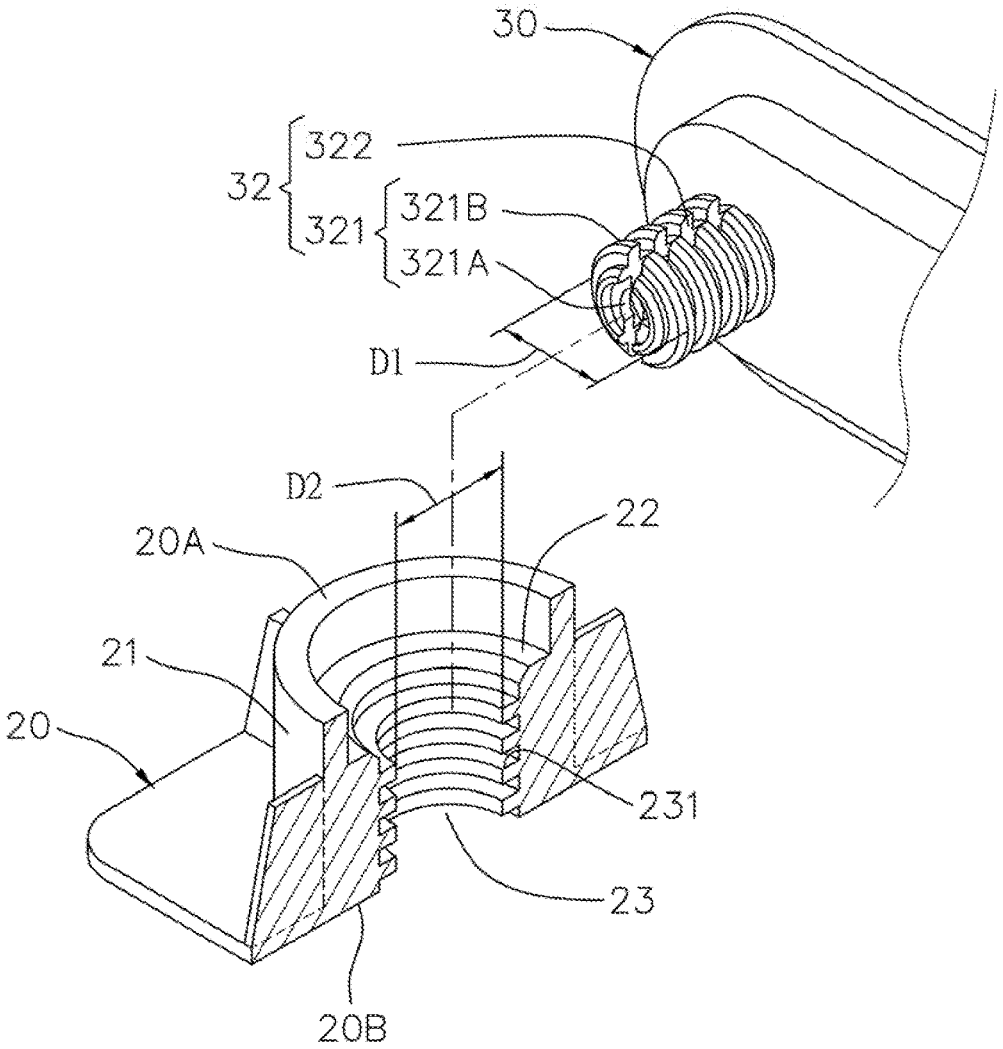
FIG. 4B illustrated the structural relationship between the box holes and the securing portion of this invention.
Figure 5:
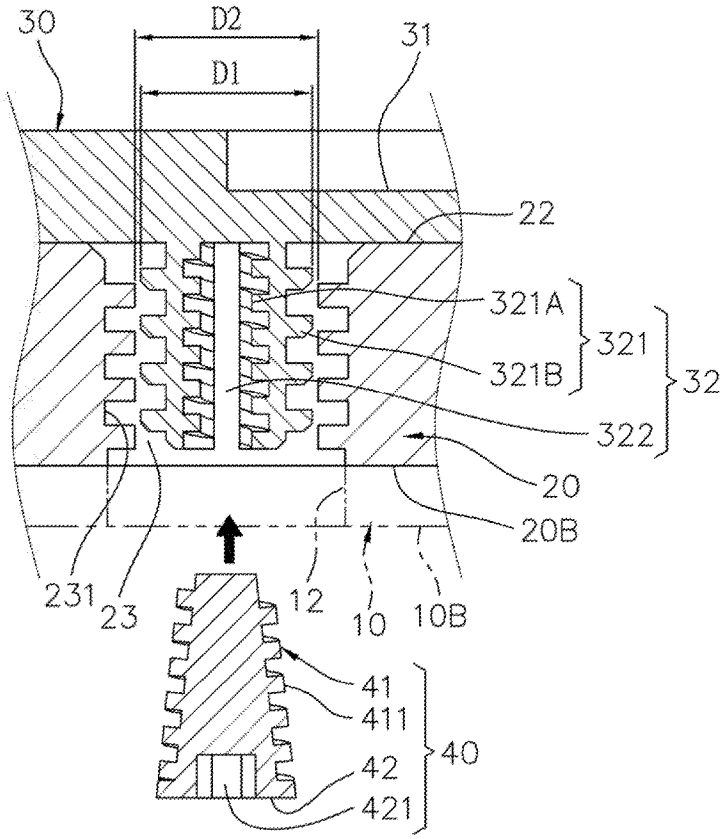

Furthermore, when there is no external force applied on the outward protruded portions 321B (which is resilient) of the curved plates 321, an outer periphery of the outward protruded portions 321B will define a first diameter D1 which is smaller than a second diameter D2 of the box hole 23 (as shown in FIGS. 4B and 5).

Practically, as illustrated in FIG. 4A, the fin engaging socket 31 can further include two (or more) tilted threaded holes 312 and two (or more) locking screw members 313. After this fin 311 is inserted into the fin engaging socket 31, these two locking screw members 313 can be screwed in the tilted threaded holes 312 so as to lock the fin 311 firmly.

Figure 6:
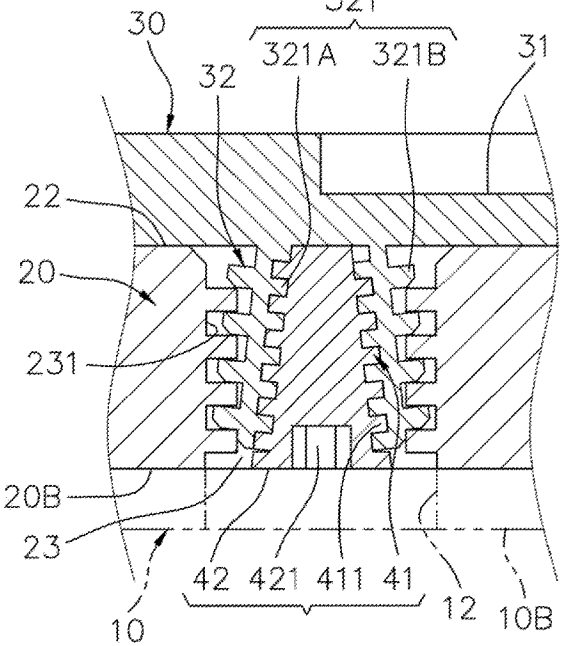
Figure 7:
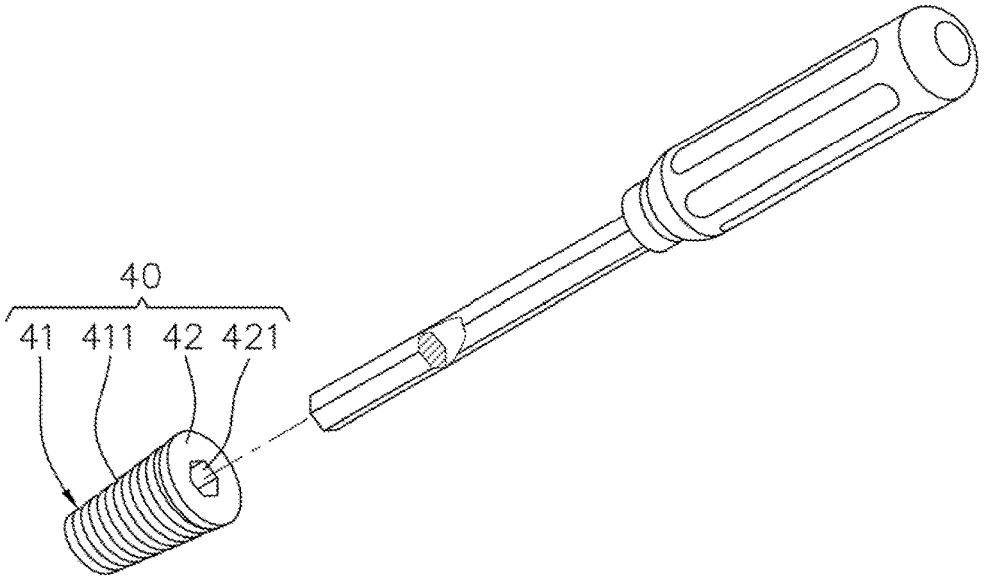
FIG. 7 is a perspective view showing that the screw member can be operated by a hand tool.

When there is no external force applied on the securing portion 32, the securing portion 32 can be move in or move from the box hole 23 freely. Once the screw member 40 is gradually rotated in and threaded into the inner threaded portion 321A of the securing portion 32 (such as by a regular hand tool, as shown in FIG. 7), the curved plates 321 will be gradually expanded outwards (As shown in FIG. 6).

The fin box 20 can be made by a plastic material. Usually, the surfboard body 10 is made by a form material. The fin box 20 can be positioned inside a mold (not shown) first and then the form material is filled into the mold (not shown) for a forming process. After it is solidified, the fin box 20 will be embedded with the surfboard body 10 together as an integral structure.

In this invention, the amount of the box holes 12 is two. The amount of the securing portions 32 and the screw members 40 are two. Of course, they can be modified into three or more.

The advantages and functions of this invention can be summarized as follows.

[1] The fin seat and the fin box can be firmly secured as one integral structure. Because this invention has several screw members, they can be screwed in and force the curved plates expanding outwards so as to engage into the corresponding circular slots. Thus, the fin seat and the fin box can be engaged together as an integral structure. The securing result is good.

[2] Its fin seat can be replaced easily. Once the screw members are rotated out, the curved plates can gradually retract inwards (by the resilient force itself). The outward protruded portions will gradually separate from the corresponding circular slots. Thus, the fin seat and the fin box are separated. Therefore, it can effectuate the function of easy to replace when the fin seat needs to be repaired or replaced.

The above embodiments are only used to illustrate the present invention, not intended to limit the scope thereof. Many modifications of the above embodiments can be made without departing from the claims of the present invention.

What is claimed is:

1. A surfboard having a fin comprising:

a surfboard body having a first surface, a second surface, a main recess, and a plurality of body holes; said main recess being recessed and formed on said first surface, said body holes being connected between said second surface and said main recess;

a fin box being disposed in said main recess, said fix box including an outer surface, an inner surface, a side surface, a box recess, several box holes; said box recess being recessed and formed on said outer surface, said box holes being connected with said box recess and said inner surface and corresponding to said body holes; each box hole having several circular slots;

a fin seat including a fin engaging socket and several securing portions; said fin engaging socket being able to secure a fin; each securing portion having several curved plates and several elongate gaps; each curved plate including an inner threaded portion and a plurality of outward protruded portions; a receiving space being formed and enclosed by said several curved plates; and a plurality of screw members, each screw member having a tapered portion and an end portion; said tapered portion being formed with an outer threaded portion which is corresponding to said inner threaded portions of said curved plates; said end portion having a connecting portion for allowing said screw member to be rotated;

wherein when said screw member being rotated and inserted into said receiving space, said outer threaded portion being threaded with said inner threaded portion so as to force said curved plates expanding outwards and forcing said outward protruded portions engaging into said corresponding circular slots, so that said fin seat and said fin box being engaged together as an integral structure; and when said screw member being rotated and moving out from said receiving space, said outer threaded portion being threaded with said inner threaded portion so as to allow said curved plates retracting inwards and causing said outward protruded portions separating from said corresponding circular slots, so that said fin seat and said fin box being separated.

2. The surfboard having a fin as defined in claim 1, wherein when there is no external force applied on said outward protruded portions, an outer periphery of said outward protruded portions defining a first diameter which is smaller than a second diameter of said box hole.

* * * * *